US005596892A

United States Patent [19]

Edgar et al.

[11] Patent Number: 5,596,892

[45] Date of Patent: Jan. 28, 1997

[54] SECURITY DRUM LOCKOUT DEVICE

[75] Inventors: Roy S. Edgar, Angola; Jerry T. Dennis; Ralph D. Trine, both of Fremont, all of Ind.

[73] Assignee: Vestil Manufacturing Company, Angola, Ind.

[21] Appl. No.: 492,802

[22] Filed: Jun. 20, 1995

[51] Int. Cl.[6] ..... B65D 55/14

[52] U.S. Cl. ..... 70/164; 70/230; 70/180

[58] Field of Search ..... 70/164, 166–168, 70/175–180, 229, 230, 158, 165, 169–174

[56] References Cited

U.S. PATENT DOCUMENTS

| | | | |
|---|---|---|---|
| 1,354,322 | 9/1920 | Madrin | 70/180 |
| 1,599,685 | 9/1926 | Spaeth | 70/165 |
| 1,615,987 | 2/1927 | Loewer | 70/230 |
| 1,806,124 | 5/1931 | Smith | 70/230 |
| 1,814,343 | 7/1931 | Smith | 70/230 |
| 2,462,951 | 3/1949 | Doubble | 70/180 |
| 2,526,238 | 10/1950 | Kendall | 70/230 |
| 4,426,863 | 1/1984 | Gillette et al. | 70/164 |
| 4,538,435 | 9/1985 | Romero | 70/183 |
| 4,655,060 | 4/1987 | Jakubus | 70/230 |
| 4,788,840 | 12/1988 | Wilson, Jr. | 70/164 |
| 4,959,980 | 10/1990 | Phillips | 70/158 |
| 5,199,286 | 4/1993 | Jakubus | 70/164 |
| 5,353,833 | 10/1994 | Martinez | 70/177 |

*Primary Examiner*—Darnell M. Boucher

*Attorney, Agent, or Firm*—Gifford, Krass, Groh, Sprinkle, Patmore, Anderson & Citkowski, P.C.

[57] ABSTRACT

A drum lockout device has a locking head with threaded plug portions for engaging either the smaller vent opening or the larger dispensing opening of a drum. When the locking head is in place, a locking key is inserted through the locking head to engage the drum end and drum flange. With a padlock securing the locking key to the locking head, the drum opening is secured against unauthorized entry.

6 Claims, 1 Drawing Sheet

SECURITY DRUM LOCKOUT DEVICE

BACKGROUND OF THE INVENTION

1. Field of the Invention

This invention relates to a drum security device. More particularly, this invention relates to means for independently locking the vent opening and the pouring opening in a drum or barrel type container.

2. State of the Art

A wide variety of liquids are shipped, stored and dispensed from drums including hazardous and non-hazardous chemicals, food stuffs and the like, and increased attention is being given to securing the contents of these drums from unauthorized use, contamination and theft.

The typical 55 gallon drum has a smaller, 1" diameter, threaded vent opening and a larger, 2¼" diameter, threaded pouring or dispensing opening. These openings are conveniently sealed with threaded plugs.

Various devices have been proposed for securing these drum openings against unauthorized access. A popular design utilizes a pair of threaded caps with a locking bar between the caps and means for securing a padlock to the device. Such a device is shown in U.S. Pat. No. 5,199,286 which also describes similar devices that are disclosed in six other patents.

SUMMARY OF THE INVENTION

The present invention relates to a simplified device that will secure either the vent opening or the dispensing opening, each independently of the other opening.

The lockout device of this invention includes a generally cylindrical locking head having a smaller threaded opening plug at one end, an intermediate larger threaded pouring opening plug, a radially extending shoulder, and an axially extending base at its other end. The base has a diametrically extending shank-hole through it. The locking device also includes a locking key which has a shank with a locking hole at one end for receiving a padlock shackle and a transversely extending handlebar at the other end of the shank. The shank of the locking key is passed through the shank hole of the locking head when either the vent opening plug or the pouring opening plug is engaged with its respective drum opening with the handlebar engaging the drum end wall adjacent the end flange of the drum. The shank has a shoulder block intermediate its ends and the handlebar and shoulder block are constructed and positioned on the shank so that the shoulder block engages the shoulder on the locking head to prevent rotation of the key relative to the locking head, and the handlebar acts against the drum flange to prevent unthreading of the locking head.

BRIEF DESCRIPTION OF THE DRAWING

The advantages of the present invention will be more apparent from the following detailed description when considered in connection with the accompanying drawing wherein.

DESCRIPTION OF THE PREFERRED EMBODIMENT

Figure 1:
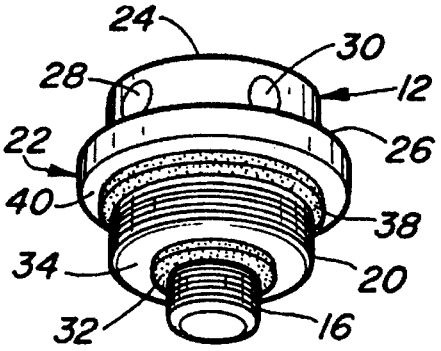
FIG. 1 is a perspective view of the locking head of the lockout device of this invention.
Figure 2:
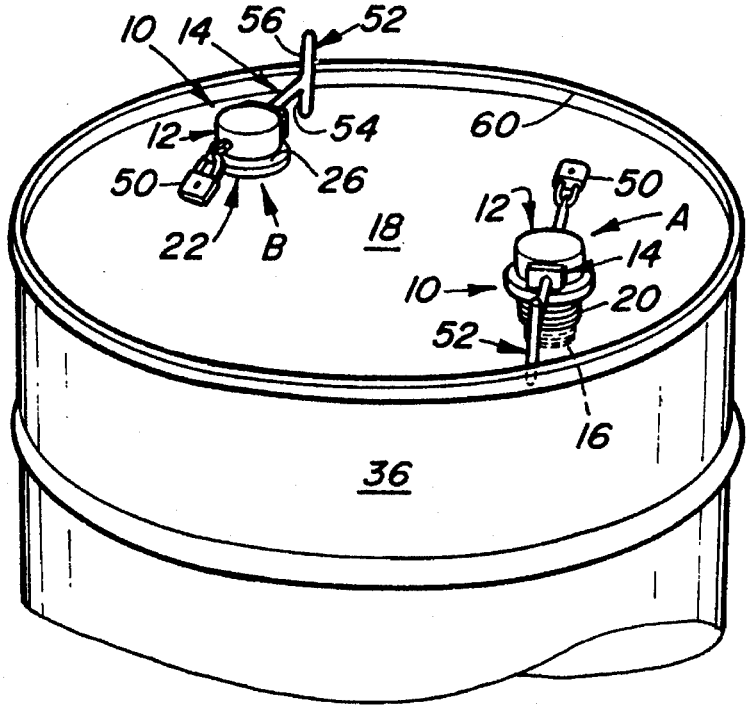
FIG. 2 is a perspective view showing one of the lockout devices of this invention engaging the pouring opening of the drum and another lockout device of this invention engaging the vent opening of the drum.
Figure 3:
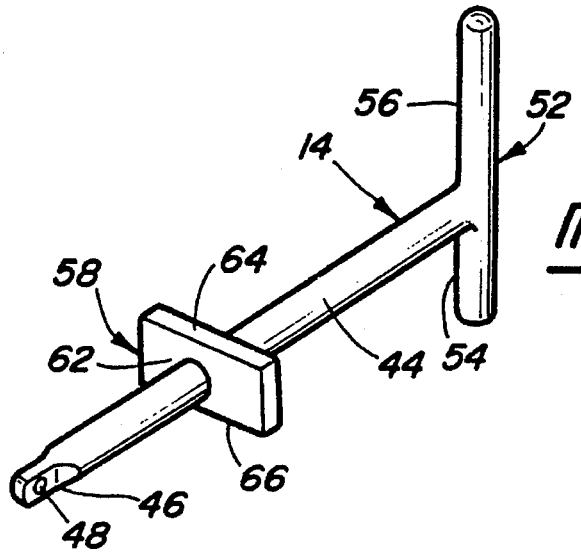
FIG. 3 is a perspective view of the locking key of the lockout device of this invention.

Referring to FIG. 2, the drum lockout device 10 of this invention includes two basic elements, namely, a generally cylindrical locking head 12, shown in detail in FIG. 1 and a locking key 14, shown in detail in FIG. 3.

The locking head 12 has a smaller diameter threaded plug 16 at one end for engaging the smaller threaded vent opening in the drum end 18 as shown at A in FIG. 2 and has an adjacent larger threaded plug 20 for engaging the larger pouring opening of the drum end wall 18 as shown at B. A radially extending shoulder 22 is provided above the larger threaded plug 20, and a cylindrical base 24 contiguous with the upper surface 26 of the shoulder is provided at the other end of the locking head 12. The base 24 has at least one diametrical through-hole 28 and preferably a second diametrical through-hole 30 at right angles to the first through-hole 28.

A gasket 32 is provided to seat against a radial surface 34 between the smaller plug 16 and the larger plug 20. The gasket 32 provides sealing between the locking head 12 and the drum end 18 when the smaller vent plug 18 inserted into the vent opening of the drum 36 as shown at A in FIG. 2. Another gasket 38 is provided to seat against the lower surface 40 of the shoulder 22. This gasket 38 provides sealing between the locking head 12 and the drum end 18 when the larger dispensing plug 20 is threaded into the dispensing opening of the drum 36 as shown at B in FIG. 2.

As shown in FIG. 3, the locking key 14 is provided with a cylindrical shank 44 having a reduced section 46 at one end with a through-hole 48 adapted to receive the shackle of a padlock 50 as shown in FIG. 2.

The locking key 14 has a handlebar 52 at its other end extending perpendicular to the shank 44 and parallel to the flattened end 48. The handlebar 52 has a shorter portion 54 extending from the shank 44 and a longer portion 56 extending from the shank 44. The locking key 14 also has a shoulder block 58 extending transversely from a midpoint of the shank 44 and transverse to the handlebar 52.

When the smaller plug 16 is threaded into the drum vent hole as shown at A in FIG. 2, the shank 44 of the locking key 14 is inserted through one of the through-holes 28 or 30 in the locking head base 24 and the key is oriented so that the longer portion 56 of the key handlebar 52 points towards and engages the drum end 18 adjacent to the upstanding drum flange 60 with the face 62 of the shoulder block adjacent or touching the locking head base 24 and the locking bar side 64 facing in the same direction as the handlebar portion 56 contacting the upper surface 26 of the shoulder 22 to prevent rotation of the locking key 14 relative to the locking head 12. With the face 62 of the shoulder block 58 abutting against the locking head base 24, the flattened shank portion 48 just extends out of the base 24 for easy attachment of the shackle of a padlock 50 which prevents removal of the key 14 from the locking head 12.

When the larger plug 20 is threaded into the drum dispensing hole as shown at B in FIG. 2, the shank 44 of the locking key 14 is inserted through one of the through-holes 28 or 30 in the locking head base 24 and the key is oriented so that the shorter portion 54 of the key handlebar 52 points toward and engages the drum end 18 adjacent to the upstanding drum flange 60 with the face 62 of the shoulder block adjacent or touching the locking head base 24 and the locking bar side 66 facing in the same direction as the shorter handlebar portion 54 contacting the upper surface 26 of the shoulder 22 to prevent rotation of the locking key 14 relative to the locking head 12.

The locking key 14 serves as a convenient tool for exerting torque on the locking head when it is being threaded into one of the drum openings, and the locking key handlebar 52 acting against the drum flange 60 prevents unthreading of the locking head when the key is in its installed position.

We claim:

1. A lockout device for a drum having an end wall, a flange extending axially outwardly from the periphery of said end wall and a threaded drum opening at a predetermined distance from said flange, said lockout device comprising:

a generally cylindrical locking head having a threaded plug at one end for engaging said drum opening and an axially extending base at its other end, said base having a diametrically extending shank receiving through-hole;

a locking key having an elongated shank, a transverse hole through one end of said shank and a handlebar extending transversely across the other end of said shank;

wherein said shank has a crossectional area smaller than said base through-hole so that said one end of said shank is insertable through said base through-hole;

a stop block secured to said shank intermediate said ends of said shank, said stop block being positioned such that, with said shank inserted through said through-hole until said stop block abuts against said base, said one end of said shank is positioned closely adjacent said base and there is a predetermined distance between said stop block and said handlebar whereby said handlebar is adapted to abut against the drum flange, and the stop block is adapted to abut against the locking head to thereby prevent a complete rotation of the locking head; and wherein said one end of said shank is adapted to receive a padlock shackle through said transverse hole.

2. The drum lockout device according to claim 1 wherein a gasket seating against a radial surface on said locking head provides sealing between said locking head and the drum end wall.

3. The drum lockout device according to claim 1 wherein said locking head has a radially extending shoulder intermediate said plug and base, and said stop block engages said shoulder when it is in abutment with said base to prevent rotation of said key relative to said locking head.

4. The drum lockout device according to claim 3 for use with a drum having a larger threaded pouring opening and a smaller threaded vent opening, both openings being at a predetermined distance from said flange, wherein said threaded plug is dimensioned to engage said threaded smaller vent opening, and wherein said locking head has a larger threaded plug intermediate said ends dimensioned to engage said larger threaded pouring opening.

5. The drum lockout device according to claim 4 wherein the handlebar of said locking key has a shorter portion extending outwardly from said shank on one side of said shank and a longer portion extending outwardly from said shank on the other side of said shank so that said shorter portion engages said drum end wall when said larger plug engages the pouring opening of said drum, and said longer portion engages said drum end wall when said smaller plug engages the vent opening of said drum.

6. The drum lockout device according to claim 4 wherein a first gasket seats against a radial surface on said locking head between said smaller plug and said larger plug, and a second gasket seats against a lower surface of said shoulder providing sealing between said locking head and the drum end wall when one of said smaller plug and larger plug engages one of said drum vent opening and said drum pouring opening.

* * * * *